US006004198A

United States Patent [19]

Sumiyoshi

[11] Patent Number: 6,004,198

[45] Date of Patent: Dec. 21, 1999

[54] WORKING TOOL, AND MATERIAL THEREFOR

[75] Inventor: Takehiko Sumiyoshi, Tokyo, Japan

[73] Assignee: Xebec Technolgy Co., Ltd., Tokyo, Japan

[21] Appl. No.: 08/832,218

[22] Filed: Apr. 3, 1997

[30] Foreign Application Priority Data

Jan. 16, 1997 [JP] Japan ..... 9-017929

[51] Int. Cl.[6] ..... B24D 11/00

[52] U.S. Cl. ..... 451/535; 451/546; 451/532; 451/536; 125/21

[58] Field of Search ..... 451/535, 546, 451/536, 532; 51/295, 294; 125/21, 536

[56] References Cited

U.S. PATENT DOCUMENTS

| | | | |
|---|---|---|---|
| 2,714,790 | 8/1955 | Lindenborg | 125/21 |
| 3,150,470 | 9/1964 | Barron | 451/535 |
| 3,280,516 | 10/1966 | Kimmerle | 451/535 |
| 4,580,545 | 4/1986 | Dorsten | 125/21 |
| 5,119,512 | 6/1992 | Dunbar et al. | 2/167 |
| 5,363,604 | 11/1994 | Heyer | 451/536 |
| 5,437,700 | 8/1995 | Dusquesne | 451/536 |
| 5,616,411 | 4/1997 | Barber, Jr. et al. | 428/373 |
| 5,695,394 | 12/1997 | Buffat et al. | 451/546 |

*Primary Examiner*—Robert A. Rose
*Assistant Examiner*—George Nguyen
*Attorney, Agent, or Firm*—Pillsbury Madison & Sutro LLP

[57] ABSTRACT

A material adapted for the preparation of a working tool contains long fiberglass arranged in the form of an entwined yarn and at least one thermosettable resin containing abrasive grains dispersed therein, which impregnates the entwined fiberglass yarn. Upon shaping and curing, a working tool is readily formed from this material in the form of any of a rotor, a stick or other desired shape.

13 Claims, 2 Drawing Sheets

WORKING TOOL, AND MATERIAL THEREFOR

BACKGROUND OF THE INVENTION

1. Field of the Invention

The present invention relates to a material which is adapted for the manufacture of a working tool, and to a working tool formed therefrom. Working tools according to the invention are suitable for cutting, drilling, grinding or polishing diverse work substrates, including: metals such as iron, iron alloy, aluminum, aluminum alloy, copper, copper alloy, titanium, titanium alloy, magnesium and magnesium alloy; or non-metals such as stones, mono- or poly-crystal silicon, ceramics and the like.

2. Description of the Prior Art

Conventional working tools such as carborundum grindstone and alumina grindstone are well-known. A carborundum grindstone is a porous block comprised of carborundum abrasive grains coupled together by a binder. But, given the porous nature of carborundum grindstones, the content of the abrasive grains is insufficient and the working efficiency of the tool constructed of this material is insufficient. Further, during use, cuttings fill the pores of the porous block to cause a blinding, whereby the workability, such as cutting quality, is degraded. In addition, Japanese Patent Publication Nos. 54-4800 and 59-97845 disclose a buff grindstone made using a fiberglass. However, this buff grindstone has a disadvantage in that the fiberglass has a low hardness, and hence, the field of application of the buff grindstone is limited. Further, because the buff grindstone is also porous, the working efficiency thereof is insufficient, and a blinding is caused.

Despite the aforementioned and other proposals, there remains a need for a working tool which is capable of cutting, drilling, grinding and polishing a work piece with a high efficiency, and which does not cause binding during use, and for a material which is capable of forming such a working tool.

SUMMARY OF THE INVENTION

It is an object of the present invention to provide a working tool such as a rotating tool and a polishing (abraiding) grindstone, wherein a large number of grinding grains is provided for applying work, such as cutting, to a work piece, e.g., work substrate, while assuring a high working efficiency such that excellent workability can be maintained without blinding.

A further object of the present invention is to provide a working tool material with a sufficiently high mechanical strength to avoid the breakage experienced with conventional grindstones.

The present invention achieves the foregoing and other objects by providing a curable material for making a working tool which comprises long fiberglass arranged in the form of an entwined yarn, and a curable thermosetting resin, which contains grinding grains, and which is impregnated into the long fiberglass. The working tool can be formed by shaping and curing the curable material into the desired geometry.

According to a second embodiment of the present invention, the material adapted for the manufacture of a working tool can comprise 20 to 40% by volume of long fiberglass, 20 to 40% by volume of abrasive grains, and 30 to 50% by volume of thermosetting resin.

According to a third embodiment of the present invention, the long fiberglass is in the form of an interlaced yarn such as fabricated in the form of an entwined yarn by an air blowing process.

According to a fourth embodiment of the present invention, the thermosetting resin comprises an unsaturated polyester resin.

According to a fifth embodiment of the present invention, the thermosetting resin comprises an epoxy resin.

According to a sixth embodiment of the present invention, the grindstone contains at least one type of abrasive grains from among diamond abrasive grains, CBN abrasive grains, silicon carbide abrasive grains, alumina abrasive grains, zirconia-alumina abrasive grains, and zirconia abrasive grains.

According to a seventh embodiment of the present invention, there is provided a rotating tool, which is made into the form of a rotor from the working tool material according to any of the first to sixth embodiments.

According to an eighth embodiment of the present invention, there is provided a polishing grindstone, which is made into the form of a stick from the working tool material according to any of the first to sixth embodiments. In principle, the polishing grindstone can have any preselected thickness. An exemplary suitable grindstone can be up to 3 mm thick.

DESCRIPTION OF THE PREFERRED EMBODIMENTS

Figure 1:
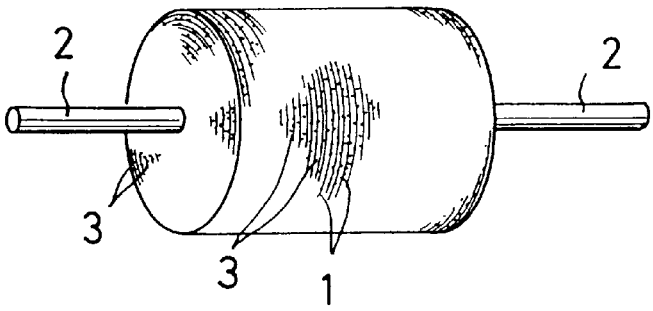
FIG. 1 is a perspective view for explaining a process for producing a working tool according to the present invention.

The present invention relates to a material which is capable of being used to manufacture a working tool, as well as to a working tool made therefrom. Working tools according to the invention are suitable for cutting, drilling, grinding or polishing: metals such as iron, iron alloy, aluminum, aluminum alloy, copper, copper alloy, titanium, titanium alloy, magnesium and magnesium alloy; or non-metals such as stones, mono- or poly-crystal silicon, ceramics and the like.

In general, the working tool material can comprise 20 to 40% by volume of the long fiberglass, 20 to 40% by volume of abrasive grains, and 30 to 50% by volume of thermosetting resin.

Long strands of fiberglass are interlaced, such as by blowing air to form an entwined strand of fiberglass. The long entwined fiberglass strand has a high tensile strength, and the working tool made using the long fiberglass has sufficient strength required for cutting, drilling, grinding and polishing.

By preference, the long fiberglass has a fiber diameter on the order of 3 $\mu$m to 25 $\mu$m. This is because the fibers presently commercially available generally have the fiber diameter in this range, and it is practically difficult to produce long fiberglass having a fiber diameter departing from this range.

The amount of long fiberglass incorporated is preferred to be on the order of 20 to 40% by volume. If the amount of long fiberglass incorporated is less than 20% by volume, the strength required for the working tool is not obtained. On the other hand, if the amount exceeds 40% by volume, abrasive grains required for a working such as cutting, drilling, grinding and polishing are not incorporated in a sufficient amount, and as a result a working tool cannot be made which satisfactorily enables the user to perform work functions, such as cutting, drilling, grinding and polishing, using that tool.

Examples of the abrasive grains which can be used are diamond abrasive grains, CBN abrasive grains, silicon carbide abrasive grains, alumina abrasive grains, zirconia-alumina abrasive grains, zirconia abrasive grains and the like. Further, the following other abrasive materials can also be used: powders of carbides such as boron carbide, titanium carbide and tungsten carbide; nitrides such as boron nitride and titanium nitride; borides such as zirconia boride, titanium boride and tungsten boride, or whiskers of silicon carbide, silicon nitride, magnesium oxide, aluminum borate, potassium titanate, and alumina. These abrasive substances can be used singly in any combination thereof.

The size of the abrasive grains may be in a range of #60 to #200,000, which enables the addition of the abrasive grains. However, if the abrasive grains have a larger size (i.e., smaller than #60), a violent sedimentation occurs within a resin cell during impregnation of the long fiberglass with the resin composition containing the abrasive grains and hence, a forming material is not produced successfully. Therefore, the use of abrasive grains having a smaller size (i.e., larger than #80) is preferred.

It is preferable that the amount of abrasive grains incorporated is on the order of 20 to 40% by volume. If the incorporated amount is lower than 20% by volume, a sufficient strength for the working tool is obtained, but a sufficient workability such as cutting, drilling, grinding and polishing is not achieved, so that the working tool merely slips on a work piece. If the incorporated amount exceeds 40% by volume, the fiberglass serving to provide a strength is not incorporated in a sufficient amount and as a result, a working tool having a satisfactory strength cannot be obtained.

The thermosetting resin containing the abrasive grains acts as a matrix (a binder) for the long fiberglass and the abrasive grains. The type of thermosetting resin is particularly not limited. In general, however, the thermosettable resin is an unsaturated polyester resin or an epoxy resin. Known curing agents and cross-linking agents can be used, if necessary, to obtain a fully cured thermosett product.

The selected abrasive grain is dispersed throughout the material according to the present invention. By preference, the abrasive grains are substantially, evenly distributed around and among the gaps which are formed in the loosened entwined yarn while preparing the material adapted for making a working tool. This provides a substantially uniformly abrading surface for the resultant working tool.

The working tool can be made starting from an entwined yarn. An entwined yarn can be made by entwining long fiberglass together by blowing air from the side in a fine tube. (Suitable entwined fiberglass yarns are also commercially available, such as from Nitto Boseki Kabushika Kaisha). The entwined yarn is then passed through a resin cell in which a thermosetting resin having at least substantially even dispersed therein the selected quantity of the chosen abrasive grains. This causes the resin composition with the dispersion of abrasive grains to be retained in gaps in the loosened entwined yarn. The entwined yarn of the fiberglass containing the given amount of the resin composition can then be wound around a rotating rotor (which may be cylindrical, rectangular or of flat plate-like shape). The entwined strand can be wound in a traverse manner, or wound in parallel. The pre-cursor material resulting from integration of the entwined strand wound around the rotor and the resin composition containing the abrasive grains can then be cut in an axial direction of the rotor and spread into a sheet-like configuration. The sheet-like configured material can be cut, if needed, into a size corresponding to the size of the mold. If required, and depending upon the thickness, a selected number of sheet-like configured pieces of material can be laminated one on another. The selected sized and configured material is placed into the heated mold, where it is subjected to a heat and pressure, such as press-molding, and cured. The selected working tool is thereby formed. The cured working tool forming material can be produced in the form of a block in the above manner, and can be shaped, e.g., cut, to the desired geometry, such as a rotor, or fabricated into a polishing grindstone in the form of a desired stick. In principle, a grindstone formed from the present composition can have any pre-selected thickness. An exemplary suitable such grindstone can be up to 3 mm thick. Alternatively, the working tool material itself may be formed directly into the desired shape of working tool, such as in the above-mentioned molding operation.

A rotating tool may be produced in the following manner: First, the entwined yarn is passed through a resin cell in which a thermosetting resin containing a given amount of abrasive grains mixed in the same manner as described above, thereby causing the resin composition containing the abrasive grains to be retained in gaps in the loosened entwined yarn. Then, the entwined yarn of the fiberglass containing the given amount of the resin composition in the above manner is wound around a rotating rotor (which may be cylindrical, rectangular or of flat plate-like shape). In this case, the entwined strand may be wound in a traverse manner, or wound in parallel. The resulting forming material is directly introduced into a mold, where the resin composition is cured on the rotor to provide a molded product. The rotor serving as an axis is withdrawn, and the cured molded product is cut into a suitable thickness.

As described above, long fiberglass in the form of the entwined strand, such as, for instance, an interlaced strand made entwined by blowing of air, has a large tensile strength, and the produced working tool has a sufficient tensile strength of 10 kg to 12 kg/mm$^2$ required for a rotating tool for cutting, drilling, grinding and polishing.

A plurality of entwined yarns can be used in the preparation of the present working tools as will be apparent to those skilled in the art.

A working tool and material therefor are described in Japanese Application 9-17929 filed Jan. 16, 1997, the complete disclosure of which is incorporated by reference.

The following non-limiting Examples further describe the present invention in conjunction with the Figures.

EXAMPLES

Example 1

First, five entwined yarns of long fiberglass ("Thermolocked yarn" sold by Nitto Boseki Kabushiki Kaisha, in the name of GBY 042 SP produced by Fuji Fiber Glass Kabushiki Kaisha) were passed through a resin cell containing a resin composition containing the following components, whereby the entwined yarn was impregnated with the resin compositions. The resulting bundle of the five entwined yarns 1 impregnated with the resin composition was wound in parallel into a width of 50 mm around an iron rod 2 having a diameter of 3 mm, until the diameter reaches 25 mm, as shown in FIG. 1. Reference character 3 in FIG. 1 indicates abrasive grains.

Epoxy resin (DER383J produced by Dow Chemical Japan) 100 parts by weight

Figure 2:
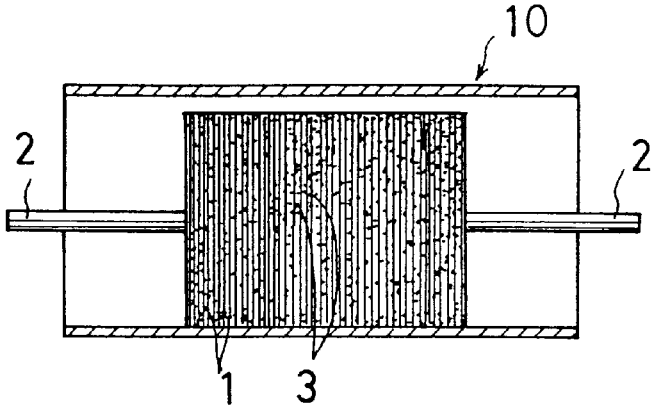
FIG. 2 is a sectional view for explaining the process for producing the working tool according to the invention.
Figure 3:
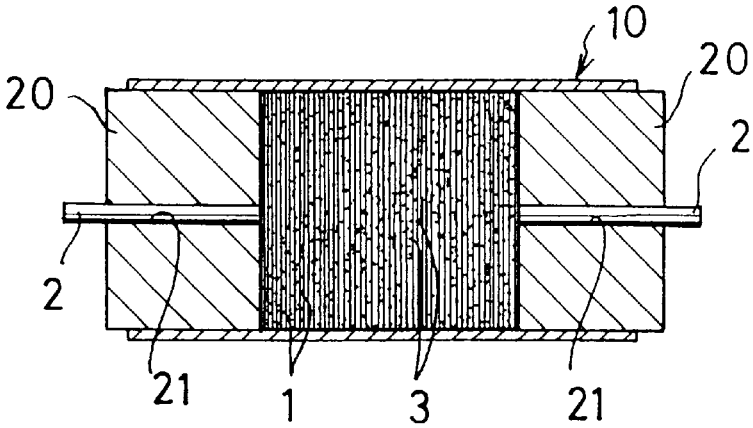
FIG. 3 is a sectional view for explaining the process for producing the working tool according to the invention.
Figure 4:
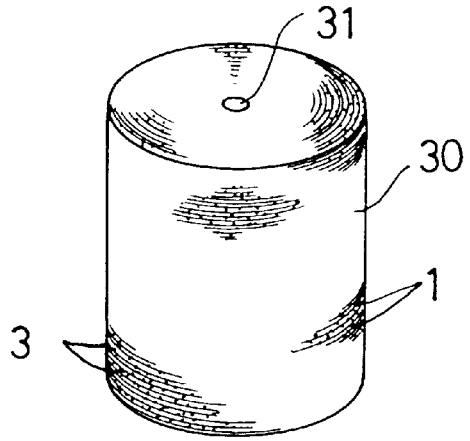
FIG. 4 is a perspective view for explaining the process for producing the working tool according to the invention.

Tetrahydromethyl phthalate anhydride (HN2200 produced by Hitachi Kasei Kogyo) 80 parts by weight Imidazole (2E4MZ-CN produced by Shikoku Kasei Kogyo) 1 part by weight Alumina abrasive grains (WA#240 made Fujimi Incorporated) 150 parts by weight Lubricant (BYK-W965 produced by Bigchemi Japan) 1 part by weight Then, as shown in FIG. 2, the resulting bundle of fiber yarns 1 wound around the rod was placed into an iron cylinder 10 having an inside diameter of 30 mm, and rods 20 of an outside diameter of 29.5 mm having a hole 21 of 3.1 mm provided at the center were inserted into the cylinder 10 from opposite ends of the cylinder 10. As shown in FIG. 3, the rods 20, 20 on the opposite sides were sandwiched and clamped by a squill vice and then introduced into a curing oven at 120° C. and cured for one hour. Thereafter, the bundle of the fiber yarns was withdrawn from the iron cylinder 10, thereby producing a polishing rod 30 having a hole 31 of 3 mm as shown in FIG. 4. As shown, hole 31 can be characterized as an axially aligned aperture extending lengthwise through the polishing rod 30.

Figure 5:
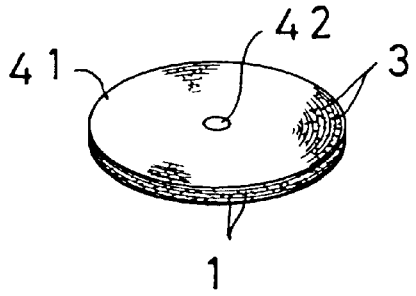
FIG. 5 is a perspective view for explaining the process for producing the working tool according to the invention.
Figure 6:
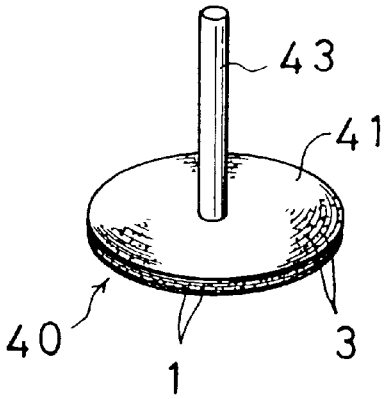
FIG. 6 is a perspective view of a working tool according to one of embodiments of the present invention.

The polishing rod 30 was milled into a thickness of 2mm to provide a disk 41, as shown in FIG. 5, and a rod 43 made of FRP including a fiberglass having a diameter of 3 mm was fixed in the hole 42 at the center of the disk 41 by use of an epoxy resin adhesive to provide a disk-like rotating tool as shown in FIG. 6.

The resulting disk-like rotating tool was comprised 30.3% by volume of the long fiberglass, 23.5% by volume of the abrasive grains, and 46.2% by volume of the thermosetting resin (now theremoset).

The rotating tool 40 was attached to a rotatable polishing device (ESPERT400 produced by Kabushiki Kaisha Nakanishi) to polish an iron mold. The result showed that a very good polished surface was provided. Moreover, the incorporation of the entwined yarn of the fiberglass was to ensure that the rotating polishing tool would be very resistant to fracture, and this was confirmed even when the polishing tool was strongly pushed against a surface to be polished it was not fractured.

Example 2

Ten entwined yarns of long fiberglass ("Thermo-locked yam" sold by Nitto Boseki Kabushiki Kaisha, in the name of GBY 042SP produced by Fuji Fiber Glass Kabushiki Kaisha) impregnated with a resin composition by passing through a resin cell containing the same resin composition as in Example 1 were wound 612 times in parallel into a width of 276 mm at distances of 12 mm around a cylinder having a diameter of 106 mm. The resulting material was cut axially and opened into a sheet-like shape and further, a cut and opened portion appearing in the form of a slope was cut down to provide a uniform length of 310 mm, thereby producing a sheet of 310 mm length×270 mm width.

The sheet was then placed into a positive mold having a size of 320 mm length×300 mm width×30 mm depth and heated to 120° C., where it was pressurized to 100 kg/cm$^2$ to squeeze an extra resin. The sheet was maintained in this state for one hour to perform a heat curing, thereby providing a plate having a size of 320 mm length and 300 mm width and having an average thickness of 4.88 mm.

The plate was cut in a direction of the fibers into a quadrilateral rod using a diamond cutter. The rod was cut to provide rounded rods having diameters of 3 mm.

The thus produced rotating tool was comprised of 23% by volume of the long fiberglass, 29.4% by volume of the abrasive grains and 47.6% by volume of the thermosetting resin (now thermoset).

This rotating tool was attached to a rotatable polishing device (ESTERT400 produced by Nakanishi) to polish an iron mold. The result showed that a very good polished surface could be provided. Moreover, the incorporation of the entwined yam of the fiberglass was to ensure that the polishing rotating tool would be very resistant to fracture, and this was confirmed because even when the polishing rotating tool was strongly pushed against the surface of the to be polished substrate it was not fractured.

Then, rotating tools similar to those in Examples 1 and 2 were made using diamond abrasive grains, CBN abrasive grains, silicon carbide abrasive grains, zirconia-alumina abrasive grains and zirconia abrasive grains in place of the alumina abrasive grains used in Examples 1 and 2 and tested and the results obtained were similar to those in Examples 1 and 2.

A rotating tool was made using a polyester resin (thermosetting unsaturated polyester type) formulation in place of the epoxy resin formulation used in Examples 1 and 2. The thus produced rotating tool was tested and the results were similar to those obtained from the tools produced according Examples 1 and 2.

In the above Example, the rotating tool was formed into a disk-like or rounded rod-like shape, but can be formed into any selected geometry, such as in a pyramidal shape, a conical shape, a pyramidal conical shape or a truncated pyramidal conical shape. The entwined yarn essentially functions as a reinforcing element and does not function as an essential working element during use, such as in polishing, and hence, the entwined yarn may be oriented in any direction with respect to the rotating tool.

Example 3

First, an entwined yarn of long fiberglass ("Thermolocked yarn" sold by Nitto Boseki Kabushiki Kaisha, in the name of GBY 042SP produced by Fuji Fiber Glass Kabushiki Kaisha) was passed through a resin cell containing a resin composition regulated into the following components, whereby the long fiberglass was impregnated with the resin composition. The long fiberglass impregnated with the resin composition was wound in parallel at distances of 3 mm into a width of 138 mm around a cylinder having a diameter of 106 mm by three repetitive runs of forward and backward winding operation to form a total of six layers.

Unsaturated polyester resin (XR301 produced by Polyurethane Kasei) 100 parts by weight Percure O (produced by Nippon Ushi) 1 part by weight Alumina abrasive grains (WA#240 Fujimi Incorporated) 150 parts by weight The entwined yam wound around the cylinder was axially cut and opened into a sheet-like shape with six layers, and a cut and opened portion appearing in the form of a slope was cut down into a uniform length of 300 mm, thereby producing a sheet having a size of 150 mm length×60 mm width.

The two sheets were then superposed one on the other and placed into a positive mold of 120° C. having a size of 150 mm length×60 mm width, where it was pressurized to 42 kg/cm$^2$ and maintained in this state for 30 minutes for heat curing, thereby providing a plate-like working tool material having a size of 150 mm length×60 mm width×1 mm thickness.

The plate-like working tool material was cut in a direction of the fibers into five test pieces, as stick-shaped tools, having a size of about 15 mm width×50 mm length×1 mm thickness by a diamond cutter and was measured for polishability and flexural strength. The result showed a polishability for an iron article and equivalent to that of a #400 grindstone. The result of measurement of the flexural strength is given in Table 1 below.

TABLE 1

| Test piece No. | Size of test piece (mm) | Span (mm) | Breaking load (kg) | Flexural Strength (kg/mm$^2$) |
|---|---|---|---|---|
| 1 | 15.9 × 50 × 1.0 | 15 | 9.1 | 12.9 |
| 2 | 15.0 × 50 × 1.0 | 15 | 10.5 | 15.8 |
| 3 | 15.3 × 50 × 1.0 | 15 | 9.2 | 13.5 |
| 4 | 14.9 × 50 × 1.0 | 15 | 9.1 | 13.7 |
| 5 | 15.3 × 50 × 1.0 | 15 | 13.4 | 19.7 |
| Average | | | | 15.1 |

As apparent from Table 1, all of the produced test pieces had sufficient flexural strength. All of the test pieces produced according to the present invention exhibited a flexural strength of at least 12.9 kilograms per square millimeter.

Comparative Example

Under the same conditions as in the Example 3, except that a "Thermo-locked Yarn" was not used, a resin mixture comprising only a white molten alumina and an unsaturated polyester resin was used to provide a plate-like working tool material having a size of 150 mm length×60 mm width× about 2 mm thickness.

The plate-like working tool material was cut, in a direction of the fibers with a diamond cutter, into five test pieces working tool material having a size of about 15 mm width× 70 mm length×about 2 mm thickness (because a strength of the material is low, the thickness was set at about 2 mm). Then flexural strength of the test pieces was measured and the results are given in Table 2.

TABLE 2

| Test piece No. | Size of test piece (mm) | Span (mm) | Breaking load (kg) | Flexural Strength (kg/mm$^2$) |
|---|---|---|---|---|
| 1 | 14.8 × 70 × 2.2 | 50 | 7.4 | 7.7 |
| 2 | 15.3 × 70 × 2.4 | 50 | 6.1 | 5.2 |
| 3 | 15.3 × 70 × 2.4 | 50 | 6.3 | 5.4 |
| 4 | 15.3 × 70 × 2.5 | 50 | 6.5 | 5.1 |
| 5 | 15.2 × 70 × 2.5 | 50 | 8.8 | 7.0 |
| Average | | | | 6.1 |

As apparent from Table 2, all of the comparison test pieces had insufficient flexural strength in comparison to the test pieces produced according to Example 3. All of the comparison test pieces had a flexural strength of less than 8 kilograms per square millimeter.

Example 4

First, ten entwined yarns of long fiberglass ("Thermo-locked yarn" sold by Nitto Boseki Kabushiki Kaisha, in the name of GBY 042SP produced by Fuji Fiber Glass Kabushiki Kaisha) were passed through a resin cell containing a resin composition regulated into the following components, whereby the long fiberglass was impregnated with the resin composition. The long fiberglass impregnated with the resin composition was wound 612 times in parallel at distances of 12 mm into a width of 276 mm around a cylinder having a diameter of 106 mm.

Epoxy resin (DER383J produced by Dow Chemical Japan) 100 parts by weight

Tetrahydromethyl phthalate anhydride (HN2200 produced by Hitachi Kasei Kogyo) 80 parts by weight Imidazole (2E4MZ-CN produced by Shikoku Kasei Kogyo) 1 part by weight Alumina abrasive grains (WA#240 made Fujimi Incorporated) 150 parts by weight Lubricant (BYK-W965 produced by Bigchemi Japane) 1 part by weight Then, the entwined yarn wound around the cylinder was axially cut and opened into a sheet-like shape, and a cut and opened portion appearing in the form of a slope was cut down into a uniform length of 310 mm, thereby producing a sheet having a size of 310 mm length×270 mm width.

Then, this sheet was placed into a positive mold of 120° C. having a size of 320 mm length×300 mm width×30 mm depth, where it was pressurized to 100 kg/cm$^2$ to squeeze out the excessive resin and maintained in this state for one hour for heat curing, thereby providing a plate-like working tool material having a size of 320 mm length×300 mm width× about 5 mm thickness.

The plate-like working tool material was cut in a direction of the fibers into five test pieces, as stick-shaped tools, having a size of about 5 mm width×70 length×about 3 mm thickness by a diamond cutter and was measured for polishability and flexural strength. The result showed a polishability for an iron article and equivalent to that of a #400 grindstone. The result of measurement of the flexural strength is given in Table 3 below.

TABLE 3

| Test piece No. | Size of test piece (mm) | Span (mm) | Breaking load (kg) | Flexural Strength (kg/mm$^2$) |
|---|---|---|---|---|
| 1 | 4.82 × 70 × 2.79 | 50 | 15.1 | 30.3 |
| 2 | 4.83 × 70 × 2.80 | 50 | 16.1 | 31.8 |
| 3 | 4.78 × 70 × 2.93 | 50 | 17.6 | 32.2 |
| 4 | 4.83 × 70 × 2.78 | 50 | 18.5 | 37.1 |
| 5 | 4.83 × 70 × 2.60 | 50 | 14.5 | 33.4 |
| Average | | | | 33.0 |

As apparent from Table 3, all of the produced test pieces exhibited sufficient flexural strength. As demonstrated, all test pieces had a measured flexural strength of at least about 30 kilograms per square millimeter.

In this way, according to the present invention, it is possible to provide a rotating tool and a working tool which are capable of cutting, drilling, grinding and polishing a work piece with a high efficiency and cannot cause a blinding, as well as a working tool material for forming the working tool. The working tool such as a rotating tool and a polishing grindstone can be formed into any shape. Moreover, a working such as cutting, drilling, grinding and polishing is performed by the abrasive grains and therefore, is not influenced by the directional property of the entwined yarn, and the working tool has no directional property to enable a working in all directions.

What is claimed is:

1. A thermosettable material, adapted for the preparation of a solid working tool, which comprises 20 to 40% by volume of substantially parallel or transversely oriented yarn formed from long fiberglass strands entwined together and a thermosetting resin which contains abrasive grains dispersed therein, wherein said thermosetting resin containing the abrasive grains is impregnated into and dispersed around and among gaps throughout the entwined fiberglass strands.

2. A material according to claim 1, wherein said material comprises; 20 to 40% by volume of said abrasive grains and 30 to 50% by volume of said thermosetting resin.

3. A material according to claim 1, wherein said long fiberglass strands are formed as an entwined yarn by blowing air.

4. A material according to claim 1, wherein said thermosetting resin comprises an unsaturated polyester resin.

5. A material for according to claim 1, wherein said thermosetting resin comprises an epoxy resin.

6. A material according to claim 1, wherein said abrasive grains comprises at least one member selected from the group consisting of diamond abrasive grains, CBN abrasive grains, silicon carbide abrasive grains, alumina abrasive grains, zirconia-alumina abrasive grains, and zirconia abrasive grains.

7. A rotating tool in the form of a rotor made from material according to claim 1.

8. A polishing grindstone in the form of a stick made from material according to claim 7.

9. A polishing grindstone according to claim 8, wherein the grindstone has a thickness of up to 3 mm.

10. A material according to claim 1, wherein said working tool is a rotating tool, an abrading grindstone or a polishing grindstone.

11. A tool according to claim 7, wherein, during use, further abrasive grains become exposed for use upon wear of an outer surface layer of the resin impregnated yarn.

12. A tool according to claim 8, wherein, during use, further abrasive grains become exposed for use upon wear of an outer surface layer of the resin impregnated yarn.

13. A material according to claim 1, wherein the flexural strength of the material is at least 12.9 $Kg/mm^2$.

* * * * *